United States Patent [19]

Van Pham

[11] Patent Number: 4,784,939

[45] Date of Patent: Nov. 15, 1988

[54] PHOTOTHERMOGRAPHIC ELEMENTS

[75] Inventor: Oanh Van Pham, St. Paul, Minn.

[73] Assignee: Minnesota Mining and Manufacturing Company, St. Paul, Minn.

[21] Appl. No.: 92,226

[22] Filed: Sep. 2, 1987

[51] Int. Cl.[4] ..... G03C 1/34

[52] U.S. Cl. ..... 430/607; 430/612; 430/617; 430/619; 430/620

[58] Field of Search ..... 430/617, 619, 620, 607, 430/612

[56] References Cited

U.S. PATENT DOCUMENTS

| | | | |
|---|---|---|---|
| 4,152,160 | 5/1979 | Ikenoue et al. | 430/617 |
| 4,173,482 | 11/1979 | Akashi et al. | 430/619 |
| 4,212,937 | 7/1986 | Akashi et al. | 430/619 |

FOREIGN PATENT DOCUMENTS

| | | |
|---|---|---|
| 54-104327 | 8/1979 | Japan . |
| 58-107534 | 6/1983 | Japan . |
| 58-145934 | 8/1983 | Japan . |
| 61-129642 | 6/1986 | Japan . |
| 1389501 | 4/1975 | United Kingdom . |

*Primary Examiner*—Won H. Louie

*Attorney, Agent, or Firm*—Donald M. Sell; Mark A. Litman

[57] ABSTRACT

Radiation sensitive thermally developable imaging elements comprise:

(a) photosensitive silver halide, (b) light insensitive silver salt oxidizing agent, (c) reducing agent for silver ions, and (d) a benzoyl acid class of antifoggant.

The antifoggants are effective in both reducing spurious background image densities and in stabilizing the film against sensitometric changes during storage.

19 Claims, No Drawings

PHOTOTHERMOGRAPHIC ELEMENTS

BACKGROUND OF THE INVENTION

1. Field of the Invention

The present invention relates to materials which reduce fog levels in photothermographic imaging elements. These elements comprise a photosensitive silver halide, silver salt oxidizing agent, and reducing agent for silver ion in a binder. The antifoggants of the present invention comprise benzoyl carboxylic acid class derivatives.

2. Background of the Art

Silver halide photothermographic imaging materials, often referred to as "dry silver" compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No. 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and U.S. Pat. No. 4,260,677 discloses the use of complexes of inorganic or organic silver salts as image source materials.

In both photographic and photothermographic emulsions, exposure of the silver halide to light produces small clusters of silver atoms. The imagewise distribution of these clusters is known in the art as the latent image. This latent image generally is not visible by ordinary means and the light sensitive article must be further processed in order to produce a visual image. The visual image is produced by the catalytic reduction of silver ions which are in catalytic proximity to the specks of the latent image.

U.S. Pat. No. 4,460,681 discloses a color photothermographic element in which color forming layers are separated by barrier layers to prevent migration of components between layers which would reduce the color separation.

U.S. Pat. No. 4,594,307 discloses a thermal diffusion transfer photothermographic element in which individual color sheets are used to provide colors. Multiple color images are formed by the use of multiple sheets of different colors.

Photothermographic emulsions, in a manner similar to photographic emulsions and other light sensitive systems, tend to suffer from fog. This spurious image density which appears in non-developmentally sensitized areas of the element. This is often reported in sensitometric results as $D_{min}$. This problem is also related to certain stability factors in the photosensitive elements where fog increases upon storage of the photosensitive element. U.S. Pat. No. 4,212,937 describes the use of a nitrogen-containing organic base in combination with a halogen molecule or an organic haloamide to improve storage stability and sensitivity. Japanese Patent Kokai No. JA 61-129642 published June 17, 1986 describes the use of halogenated compounds to reduce fog in color-forming photothermographic emulsions. These compounds include acetophenones including phenyl-(alpha,alpha-dibromobenzyl)-ketone.

U.S. Pat. No. 4,152,160 describes the use of carboxylic acids including benzoic acids and phthalic acids in photothermographic elements. These acids are used as antifoggants. The benzoic acids have the general formula

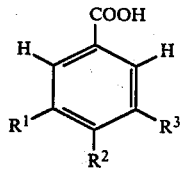

with the various substituents selected from amongst hydrogen, cyano, nitro and halogen.

BRIEF DESCRIPTION OF THE INVENTION

The use of benzoyl acid compounds having the general formula

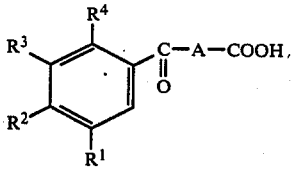

wherein $R^1$, $R^2$, $R^3$ and $R^4$ are selected from halogen, cyano, nitrogen and hydrogen, and at least one of $R^1$, $R^2$, $R^3$ and $R^4$ are other than hydrogen, and A is alkylene, arylene, alkarylene, or aralkylene, preferably with no more than six carbon atoms in any alkylene or arylene groups and no more than 10 carbon atoms in any aralkylene or alkarylene group, on photothermographic emulsions reduces fog and improves the stability of those emulsions.

DETAILED DESCRIPTION OF THE INVENTION

The generation of fog in photoghermographic elements comprising photosensitive silver halide, organic silver salt oxidizing agent, and reducing agent for silver ion can be reduced by the addition of a fog-reducing effective amount of carboxylic acid benzoyl compound.

The carboxylic acid benzoyl compounds useful in the practice of the present invention may be generally represented by the formula

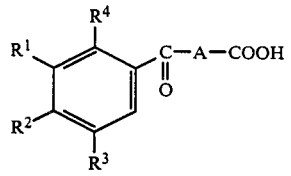

wherein $R^1$, $R^2$, $R^3$ and $R^4$ are independently selected from the group consisting of halogen (F, Cl, Br or I), cyano, nitro, or hydrogen with the proviso that at least one of $R^1$, $R^2$ and $R^3$ are other than hydrogen, and A is selected from the group consisting of alkylene, arylene, alkarylene, and aralkylene.

Preferably $R^1$, $R^2$ and $R^3$ are halogen, and preferably the halogen is in para-position to the carboxylic acid group. Preferably alkylene and arylene have no more than six carbon atoms and alkarylene and aralkylene have no more than ten carbon atoms. A is preferably arylene or alkylene. More preferably A is methylene, ethylene, or propylene or phenylene (ortho, para, or meta).

The synthesis of these compounds is known in the literature, but there use in photothermographic emulsions has not been disclosed. Typical synthetic procedures useful in forming these compounds are found in *Chem. Pharm, Bull.*, 31 (8) 2632–2638 (1983), "Studies on Benzhydryl Derivatives IV", Shoji Takemura et al., Jan. 14, 1983; Journal of The Chemical Society, Section B Physical Organic Chemistry, Part 1. pp. 145–148, 1971, London: The Chemical Society.

These compounds are used in general amounts of at least 0.005 moles/mole of silver in the emulsion layer. Usually the range is between 0.005 and 1.0 moles of the acid per mole of silver and preferably between 0.01 and 0.3 moles of acid per mole of silver.

Typically, photothermographic chemistry is prepared in a single composition with binder, and are formed in any manner which does not developmentally sensitize the silver halide in the chemistry.

Conventional silver halide photothermographic chemistry is used as the photothermographic chemistry in the system of the present invention. Such chemistry is well described in U.S. Pat. Nos. 3,457,075; 3,839,049; 3,985,565; 4,022,617 and 4,460,681. These can be either black-and-white or color chemistries. Either in situ halidization (e.g., 3,457,075) or preformed silver halide sources (e.g., 3,839,049) may be used. Any of the various photothermographic media, such as full soaps, partial soaps, full salts, and the like may be used in the photothermographic chemistry contained in the particles.

Conventional photothermographic chemistry comprises a photosensitive silver halide catalyst, a silver compound capable of being reduced to form a metallic silver image (e.g., silver salts, both organic and inorganic, and silver complexes, usually light insensitive silver materials), a developing agent for silver ion (a mild reducing agent for silver ion), and a binder. Color photothermographic systems additionally have a leuco dye or dye forming developer (alone or in combination with a developer for silver ion), or a color photographic coupler which would require a color photographic developer to be used as the developing agent for silver ion. Thus both negative and positive systems can be used.

The leuco dyes and dye forming developers used in the present invention may be any colorless or lightly colored (i.e., Dmax of less than 0.2 in a concentration of 5% by weight in a 20 micron thick transparent binder layer) compound which forms a visible dye upon oxidation. The compound must be oxidizable to a colored state. Compounds which are both pH sensitive and oxidizable to a colored state are useful but not preferred, while compounds only sensitive to changes in pH are not included within the term "leuco dyes" since they are not oxidizable to a colored form.

The dyes formed from the leuco dyes in the various color-forming particles should of course be different. A difference of at least 60 nm in reflective or transmissive maximum absorbance is required. Preferably the absorbance maximum of dyes formed will differ at least 80 or 100 nm. When three dyes are to be formed, two should differ by at least these minimums, and the third should differ from at least one of the other dyes by at least 150 nm and preferably at least 200 or even at least 250 nm. This will provide a good, full color range for the final image.

Any leuco dye capable of being oxidized by silver ion to form a visible dye is useful in color forming systems of the present invention as previously noted. Dye forming developers such as those disclosed in U.S. Pat. Nos. 3,445,234; 4,021,250; 4,022,617 and 4,368,247 are useful. In particular, the dyes listed in Japanese Kohyo National Publication No. 500352/82, published Feb. 25, 1982 are preferred. Naphthols and arylmethyl-1-naphthols are generally preferred.

Conventional photothermographic chemistry is usually constructed as one or two layers on a substrate. Single layer constructions must contain the silver source material, the silver halide, the developer and binder as well as optional additional materials such as toners, coating aids and other adjuvants. Two-layer constructions must contain silver source and silver halide in one emulsion layer (usually the layer adjacent substrate) and the other ingredients in the second layer or both layers. In the present invention it is preferred to use single layer chemistry.

The silver source material, as mentioned above, ordinarily may be any material which contains a reducible source of silver ions. Silver salts of organic acids, particularly long chain (10 to 30, preferably 15 to 28 carbon atoms) fatty carboxylic acids are preferred in the practice of the present invention. Complexes of organic or inorganic silver salts wherein the ligand has a gross stability constant between 4.0 and 10.0 are also useful in the present invention. The silver source material should constitute from about 20 to 70 percent by weight of the imaging layer. Preferably it is present as 30 to 55 percent by weight.

The silver halide may be any photosensitive silver halide such as silver bromide, silver iodide, silver chloride, silver bromoiodide, silver chlorobromoiodide, silver chlorobromide, etc., and may be added to the layer in any fashion which places it in catalytic proximity to the silver source. The silver halide is generally present as 0.75 to 15 percent by weight of the particle, although larger amounts are useful. It is preferred to use from 1 to 10 percent by weight silver halide in the layer and most preferred to use from 1.5 to 7.0 percent.

The silver halide may be provided by in situ halidization or by the use of pre-formed silver halide. The use of sensitizing dyes for the silver halide is particularly desirable. These dyes can be used to match the spectral response of the emulsions to the spectral emissions of intensifier screens. It is particularly useful to use J-banding dyes to sensitive the emulsion as disclosed in U.S. Pat. No. 4,476,220.

The reducing agent for silver ion may be any material, preferably organic material, which will reduce silver ion to metallic silver. Conventional photographic developers such as phenidone, hydroquinones, and catechol are useful, but hindered phenol reducing agents are preferred. The reducing agent should be present as 1 to 20 percent by weight of the imaging particle. In a two-layer construction, if the reducing agent is in the second layer, slightly higher proportions, of from about 2 to 20 percent tend to be more desirable.

Toners such as phthalazinone, phthalazine and phthalic acid are not essential to the construction, but are highly desirable. These materials may be present, for example, in amounts of from 0.2 to 5 percent by weight.

The binder may be selected from any of the well known natural and synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are, of course, included in these definitions. The polyvinyl acetals, such as polyvinyl butyral and polyvinyl formal, and vinyl copolymers, such as polyvinyl acetate/chloride are particularly desirable. The binders are generally used in a range of from 20 to 75 percent by weight of the silver containing layer, and preferably about 30 to 55 percent by weight.

In describing materials useful according to the present invention, the use of the term "group" to characterize a class, such as alkyl group, indicates that substitution of the species of that class is anticipated and included within that description. For example, alkyl group includes hydroxy, halogen, ether, nitro, aryl and carboxy substitution while alkyl or alkyl radical includes only unsubstituted alkyl.

As previously noted, various other adjuvants may be added to the photothermographic layer of the present invention. For example, toners, accelerators, acutance dyes, sensitizers, stabilizers, surfactants, lubricants, coating aids, antifoggants, leuco dyes, chelating agents, binder crosslinking agents, and various other well-known additives may be usefully incorporated in the layers. The use of acutance dyes matched to the spectral emission of an intensifying screen is particularly desirable.

It has also been found in the practice of the present invention that the direct addition of halogen molecules into the emulsion prior to coating on a substrate tends to further improve fog and stability in the emulsion. The halogen molecule may be molecular chlorine ($Cl_2$), bromine ($Br_2$) or iodine ($I_2$), as well as IBr, ICl, BrCl, and like molecular halogen compounds. These molecular halogens may generally be used in amounts between 0.0001 and 0.1 moles molecular halogen per mole of silver in the emulsion.

EXAMPLES 1-5

A silver behenate dispersion was first prepared by homogenizing 150 g of a silver behenate half soap (converted to 14% silver by weight) and 850 g acetone. A photothermographic emulsion was prepared by using 150 g of the dispersion with the following ingredients, each added in its listed order with mixing:

56.0 g toluene
10.0 g acetone
0.30 g poly(vinylbutyral) B-76
2.0 ml of ZnBr solution (10 g ZnBr per 100 ml of methanol)

The mixture was held for 4 hours. To this was added:

28.8 g poly(vinylbutyral) B-76
7.5 g 1,1-bis(1-hydroxy-3-tert-butyl-2-phenyl)hexane (antifoggant)
2.0 ml Lith 421 sensitizing dye (0.26 g dye/100 ml methanol)

The resulting composition was first coated on paper or opaque polyester by means of a knife coater. A dry coating weight of 11 g/m$^2$ was applied.

An active, protective top coat solution was prepared with the following ingredients:

55.7 g acetone
17.5 g methyl ethyl ketone
11.1 g toluene
4.5 g cellulose acetate
0.51 g phthalazine
0.36 g 4-methyl phthalic acid
0.21 g tetrachlorophthalic acid
0.17 g phthalic anhydride The solution was coated at 0.2 g/ft$^2$ (2.15 g/m$^2$) over the first coating. Each layer was dried at 180° F. (80° C.) for three minutes. The coated material was then exposed through a continuous tone density wedge with a zenon flash at multi-second duration. After exposure, the material was processed at 255° F. (118° C.) for six seconds. The image obtained was evaluated by a densitometer. Various additions of antifoggants and stabilizers were made in the amounts indicated in Table I. These were added to the first coating in the above described article.

TABLE

| | Antifoggant | Amount (grams) | Dmin | Dmax | Gamma | Speed |
|---|---|---|---|---|---|---|
| A. | None | | 0.20 | 1.91 | 4.10 | 100 |
| 1. | 2-(4-chlorobenzoyl)-benzoic acid | 0.75 | 0.14 | 1.92 | 4.63 | 87 |
| 2. | 3-(4-chlorobenzoyl)-propionic acid | 0.75 | 0.14 | 1.93 | 4.53 | 86 |
| B. | mercuric acetate | 0.15 | 0.16 | 1.98 | 4.60 | 84 |
| C. | $I_2$ | 0.03 | 0.12 | 1.92 | 4.55 | 86 |
| D. | $Br_2$ | 0.02 | 0.13 | 1.92 | 4.55 | 85 |
| 3. | 2-(4-chlorobenzoyl)-benzoic acid and $I_2$ | 0.75+ 0.03 | 0.09 | 2.05 | 3.45 | 89 |
| E. | $I_2$ and mercuric acetate | 0.03+ 0.15 | 0.10 | 2.02 | 3.50 | 91 |
| 4. | 2-(4-chlorobenzoyl)-benzoic acid and | 0.75+ 0.15 | 0.10 | 2.02 | 3.50 | 91 |

TABLE-continued

| Antifoggant | Amount (grams) | Dmin | Dmax | Gamma | Speed |
|---|---|---|---|---|---|
| mercuric acetate | | | | | |
| 5. 3-(4-chlorobenzoyl)-propionic acid and mercuric acetate | 0.75+ 0.15 | 0.11 | 2.05 | 3.30 | 90 |

Good fog reduction properties are shown in the use of these benzoyl materials, alone and in combination with other antifoggants. Similar results were found in the use of preformed silver halide materials.

EXAMPLE 6

Example 1 was repeated except that 0.75 g of 3-(4-fluorobenzoyl)propionic acid was used in place of the 2-(4-chlorobenzoyl)benzoic acid. Results were comparable.

EXAMPLES 7–9

Example 1 was repeated with the addition of certain N-haloimides. The films were imaged and developed as before and the results shown in the table below.

| Example | N—haloimide | Weight (g) | Dmax | Dmin | γ | Relative Speed |
|---|---|---|---|---|---|---|
| 7 | N—bromosuccinimide | 0.02 | 1.95 | 0.09 | 3.75 | 92 |
| 8 | N—chlorophthalimide | 0.02 | 1.92 | 0.12 | 3.35 | 68 |
| 9 | N—iodosuccinimide | 0.03 | 2.04 | 0.09 | 3.52 | 91 |

The N-haloimides tend to leave residues in the emulsion of the dehalogenated derivative. The concentration of those residues, as would be the original amounts of the N-haloimides, would be far less than those amounts used to originally sensitize the emulsions as in U.S. Pat. No. 4,212,927.

What is claimed is:

1. A photothermographic emulsion comprising photosensitive silver halide, silver oxidizing compound, reducing agent for silver ion, and a binder which contains a fog-suppressing effective amount of a compound having the formula

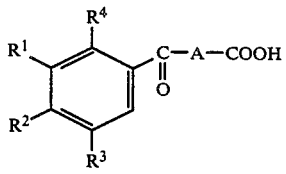

wherein $R^1$, $R^2$, $R^3$ and $R^4$ are independently selected from the group consisting of hydrogen, halogen, cyano and nitro, with the proviso that at least one of $R^1$, $R^2$, $R^3$ and $R^4$ are other than hydrogen, and A is selected from the group consisting of arylene, alkylene, aralkylene and alkarylene.

2. The emulsion of claim 1 wherein A is alkylene.

3. The emulsion of claim 1 wherein one of $R^1$, $R^2$, $R^3$ and $R^4$ is halogen.

4. The emulsion of claim 2 wherein one of $R^1$, $R^2$, $R^3$ and $R^4$ is halogen.

5. The emulsion of claim 1 wherein one of $R^1$, $R^2$, $R^3$ and $R^4$ is halogen and the remainder are hydrogen.

6. The emulsion of claim 2 wherein one of $R^1$, $R^2$, $R^3$ and $R^4$ is halogen and the remainder are hydrogen.

7. The emulsion of claim 1 wherein A is phenylene.

8. The emulsion of claim 7 wherein one of $R^1$, $R^2$, $R^3$ and $R^4$ is halogen.

9. The emulsion of claim 7 wherein one of $R^1$, $R^2$, $R^3$ and $R^4$ is halogen and the remainder are hydrogen.

10. The emulsion of claim 1 further comprising an antifoggant selected from the group consisting of molecular halogen, N-haloimides, and mercuric salts.

11. The emulsion of claim 2 further comprising an antifoggant selected from the group consisting of molecular halogen, N-haloimides, and mercuric salts.

12. The emulsion of claim 3 further comprising an antifoggant selected from the group consisting of molecular halogen, N-haloimides, and mercuric salts.

13. The emulsion of claim 7 further comprising an antifoggant selected from the group consisting of molecular halogen, N-haloimides, and mercuric salts.

14. The emulsion of claim 8 further comprising an antifoggant selected from the group consisting of molecular halogen, N-haloimides, and mercuric salts.

15. The emulsion of claim 9 further comprising an antifoggant selected from the group consisting of molecular halogen, N-haloimides, and mercuric salts.

16. The emulsion of claim 1 further comprising an antifoggant selected from the group consisting of molecular halogen and N-haloimide present in an amount of from 0.0001 to 0.1 moles/mole of silver.

17. The emulsion of claim 2 further comprising an antifoggant selected from the group consisting of molecular halogen and N-haloimide present in an amount of from 0.0001 to 0.1 moles/mole of silver.

18. The emulsion of claim 7 further comprising an antifoggant selected from the group consisting of molecular halogen and N-haloimide present in an amount of from 0.0001 to 0.1 moles/mole of silver.

19. The emulsion of claim 8 further comprising an antifoggant selected from the group consisting of molecular halogen and N-haloimide present in an amount of from 0.0001 to 0.1 moles/mole of silver.

* * * * *